US009658597B2

(12) United States Patent
Dubois et al.

(10) Patent No.: US 9,658,597 B2
(45) Date of Patent: May 23, 2017

(54) TIMEPIECE MECHANISM HAVING A CONTACT PAIR WITH NO LUBRICATION

(71) Applicant: Nivarox-FAR S.A., Le Locle (CH)

(72) Inventors: Philippe Dubois, Marin (CH); Christian Charbon, Chezard-St-Martin (CH); Cedric Faure, Cortaillod (CH); Rudy Charlery, Bienne (CH)

(73) Assignee: Nivarox-FAR S.A., Le Locle (CH)

( * ) Notice: Subject to any disclaimer, the term of this patent is extended or adjusted under 35 U.S.C. 154(b) by 133 days.

(21) Appl. No.: 14/707,696

(22) Filed: May 8, 2015

(65) Prior Publication Data

US 2015/0331391 A1 Nov. 19, 2015

(30) Foreign Application Priority Data

May 16, 2014 (EP) ..... 14168699

(51) Int. Cl.
*G04B 15/14* (2006.01)
*G04B 13/02* (2006.01)

(52) U.S. Cl.
CPC ..... *G04B 15/14* (2013.01); *G04B 13/02* (2013.01); *Y10T 29/49581* (2015.01)

(58) Field of Classification Search
CPC ..... G04B 15/14; G04B 31/004
See application file for complete search history.

(56) References Cited

U.S. PATENT DOCUMENTS

2010/0006540 A1* 1/2010 Dinger ..... B81C 99/008 216/41
2012/0263909 A1* 10/2012 Gluche ..... B81B 3/0075 428/76

FOREIGN PATENT DOCUMENTS

EP 0 732 635 A1 9/1996
EP 1 233 314 A1 8/2002

OTHER PUBLICATIONS

European Search Report issued Feb. 18, 2015 in European Application 14168699.8, filed on May 16, 2014 (with English translation).

* cited by examiner

*Primary Examiner* — Amy Cohen Johnson
*Assistant Examiner* — Jason Collins
(74) *Attorney, Agent, or Firm* — Oblon, McClelland, Maier & Neustadt, L.L.P.

(57) ABSTRACT

A timepiece mechanism including a pair of components with a first component including a material taken from a first group including solid monocrystalline, natural diamond, micro- or nano-crystalline CVD diamond, solid monocrystalline diamond, and amorphous carbon "DLC", and having a first friction surface arranged to cooperate with a second friction surface included in a second opposing component and the second component includes, at least in its second friction surface, a material with a high concentration of boron, greater than 10 atomic percent, and, in a particular embodiment, this second opposing component includes at least one ceramic containing boron. Method for manufacturing such a mechanism. Method for transforming such a mechanism.

31 Claims, 1 Drawing Sheet

TIMEPIECE MECHANISM HAVING A CONTACT PAIR WITH NO LUBRICATION

This application claims priority from European Patent Application No. 14168699.8 filed May 16, 2014, the entire disclosure of which is incorporated herein by reference.

FIELD OF THE INVENTION

The invention concerns a timepiece mechanism with improved tribology.

The invention more particularly concerns a timepiece mechanism including at least one pair of components comprising a first component including a material taken from a first group including silicon dioxide (SiO2) natural diamond, micro- or nano-crystalline CVD diamond, solid monocrystalline diamond and amorphous carbon known as diamond-like carbon or "DLC", and having a first friction surface arranged to cooperate with a second friction surface comprised in a second opposing component.

The invention also concerns a timepiece movement including such a mechanism.

The invention also concerns a timepiece including such a timepiece movement and/or such a mechanism.

The invention also concerns a method for making a mechanism of this type.

The invention also concerns a method of transforming such a mechanism.

The invention concerns the field of timepiece mechanisms including components that are permanently in motion, and more specifically the field of escapement mechanisms.

BACKGROUND OF THE INVENTION

Timepiece designers have always endeavoured to increase the reliability of movements, as a result of reducing the frequency of maintenance operations, while ensuring accurate operation of the timepiece movements.

The lubrication of wheels and pinions and moving components is a difficult problem to resolve. Lengthy tribological testing is required to develop solutions to simplify or even eliminate lubrication.

More specifically, it is sought to achieve lubrication-free operation of escapement mechanisms, by attempting to define pairs of materials in friction having a stable, low coefficient of friction and low wear, and exhibiting excellent resistance over time.

Within the scope of the use of materials in non-lubricated friction contact in the timepiece escapement, recent studies tend to show that micro- or nano-crystalline CVD diamond in friction against itself results in the escapement stopping after a limited operating time. This issue necessitates lubrication followed by regular maintenance in the manner of a conventional steel/ruby escapement.

EP Patent Application No 1233314A1 in the name of DAMASKO discloses an escapement mechanism with a pallet lever and escape wheel, wherein at least one of the contact surfaces is coated with DLC.

EP Patent Application No 0732635A1 in the name of CSEM discloses the manufacture of a micromechanical component, particularly a pallet lever of an escapement, with a friction surface including silicon nitride, in an unspecified composition. This document envisages a pair with a counter-piece?, with improved tribology: this document cites a titanium nitride against titanium carbide pair, or a titanium nitride against silicon carbide pair.

SUMMARY OF THE INVENTION

The invention proposes to provide a solution to this problem.

An object of the invention is the non-lubricated operation of the timepiece mechanism by preventing blocking phenomena appearing in an escapement containing pallet-stones and an escape wheel coated in CVD diamond.

The invention more particularly concerns the use of materials containing boron, in at least one of the contact surfaces within a timepiece mechanism.

To this end, the invention concerns a timepiece mechanism comprising at least one pair of components including a first component including a material taken from a first group including silicon dioxide (SiO2), natural diamond, micro- or nano-crystalline CVD diamond, solid monocrystallinesolid monocrystalline diamond, and amorphous carbon known as diamond-like carbon or "DLC", and having a first friction surface arranged to cooperate with a second friction surface comprised in a second opposing component, characterized in that said second opposing component includes, at least in said second friction surface, a material with a high concentration of boron, more than 10 atomic percent, and in that said second opposing component includes at least one ceramic containing boron.

The invention concerns a timepiece mechanism comprising at least one pair of components including a first component including a material taken from a first group including silicon dioxide (SiO2), natural diamond, micro- or nano-crystalline CVD diamond, solid monocrystalline diamond, and amorphous carbon known as diamond-like carbon or "DLC", and having a first friction surface arranged to cooperate with a second friction surface comprised in a second opposing component, characterized in that said second opposing component includes, at least in said second friction surface, a material with a high concentration of boron, more than 10 atomic percent, and characterized in that said first component includes a first friction layer, and in that said first component is in one-piece with said first friction layer in a material taken from said first group.

The invention also concerns a timepiece mechanism including at least one pair of components comprising a first component including a material taken from a first group including silicon dioxide (SiO2) natural diamond, micro- or nano-crystalline CVD diamond, and amorphous carbon known as diamond-like carbon or "DLC", and having a first friction surface arranged to cooperate with a second friction surface comprised in a second opposing component, characterized in that said second opposing component includes, at least in said second friction surface thereof, a material with a high concentration of boron, greater than 10 atomic percent, and characterized in that said second component includes a surface friction layer, and in that said second component is in one-piece with said second friction layer in a material formed by a ceramic containing boron, or including at least one ceramic containing boron.

The invention also concerns a timepiece mechanism comprising at least one pair of components including a first component including a material taken from a first group including silicon dioxide (SiO2), natural diamond, micro- or nano-crystalline CVD diamond, solid monocrystalline diamond, and amorphous carbon known as diamond-like carbon or "DLC", and having a first friction surface arranged to cooperate with a second friction surface comprised in a second opposing component, characterized in that said second opposing component includes, at least in said second friction surface thereof, a material with a high concentration of boron, more than 10 atomic percent, and characterized in that the mechanism is an escapement mechanism and includes a plurality of said pairs, each formed on the basis, on the one hand, of a tooth of an escapement wheel set, and on the other hand, of a pallet-stone of a pallet lever.

The invention also concerns a timepiece movement including such a mechanism.

The invention also concerns a timepiece including such a timepiece movement and/or such a mechanism.

The invention also concerns a method for making a mechanism of this type, characterized in that:

- one said first component is made and coated with one said first friction layer in a material taken from said first group;
- one said second component is made and coated with one said second layer formed by a ceramic containing boron, or including at least one ceramic containing boron;
- one said first friction surface of said first friction layer is made to cooperate in dry contact, without lubricant, with one said second friction surface of said second friction layer.

The invention also concerns a method for making a timepiece mechanism of the type comprising at least one pair of components including a first component including a first friction surface arranged to cooperate with a second friction surface comprised in a second opposing component, characterized in that:

- a first friction layer in a material taken from a first group including silicon dioxide, natural diamond, micro- or nano-crystalline CVD diamond, solid monocrystalline diamond, and amorphous carbon known as diamond-like carbon or "DLC" is applied to said first friction surface to form a new first hard friction surface, and
- a second friction layer, formed by a ceramic containing boron or including at least one ceramic containing boron, is applied to said second friction surface to form a new second hard friction surface, and
- said new first hard friction surface is made to cooperate in dry contact, with said new second hard friction surface.

BRIEF DESCRIPTION OF THE DRAWINGS

Other features and advantages of the invention will appear upon reading the following detailed description, with reference to the annexed drawings, in which.

DETAILED DESCRIPTION OF PREFERRED EMBODIMENTS

Figure 1:
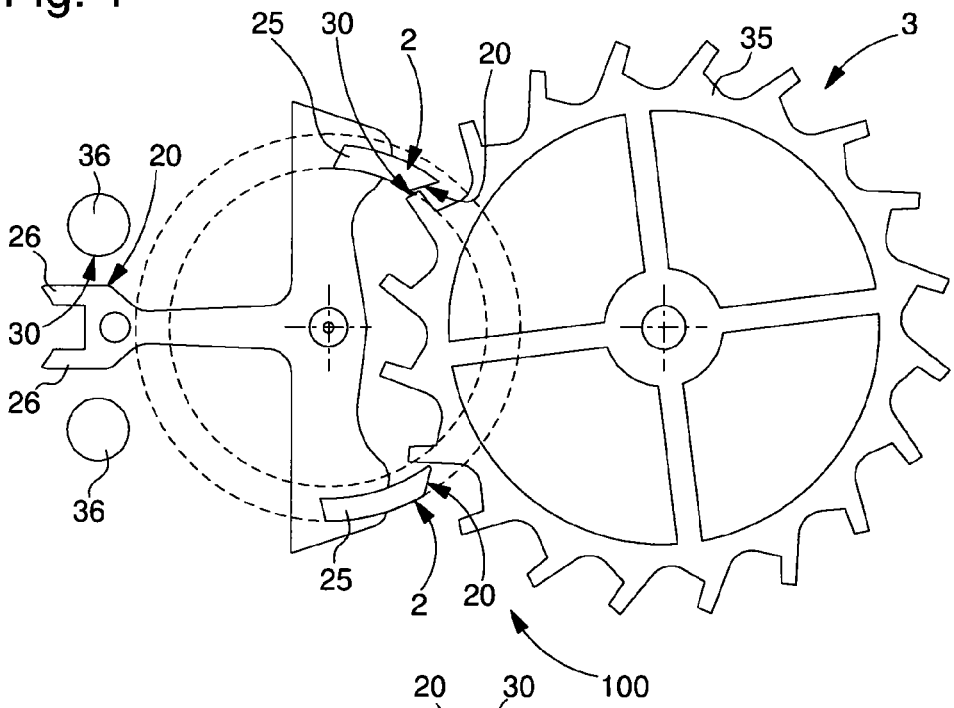
FIG. 1 shows a schematic, plan view of an escapement mechanism including, in particular, a pallet-stone cooperating in contact with an escape wheel, on contact surfaces arranged according to the invention.
Figure 2:
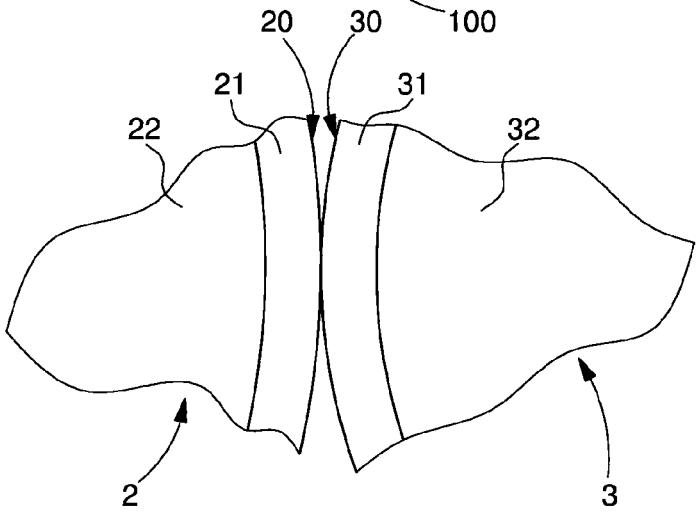
FIG. 2 shows a schematic view of the cooperation between the opposing contact surfaces.
Figure 3:
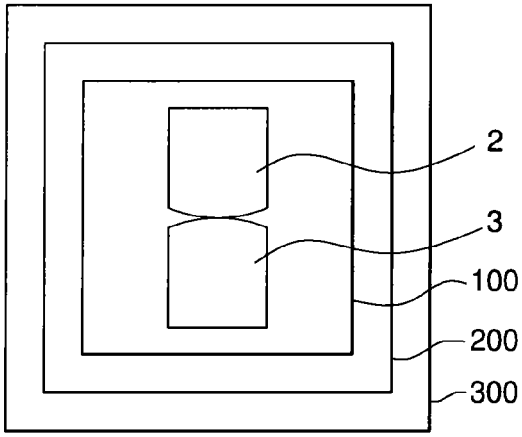
FIG. 3 shows block diagrams of a timepiece comprising a movement which includes an escapement mechanism which in turn comprises a pair of components arranged according to the invention.

The invention concerns the use of materials containing boron, and more specifically boron ceramics, in non-lubricated friction contact against diamond in a timepiece movement.

The invention consists in replacing one of the partners in friction, usually diamond against diamond, with a material containing boron, and more specifically with a ceramic containing boron, in particular a non-oxide ceramic.

Those skilled in the art know (non-lubricated tribology of diamond) that dangling surface bonds may lead to the creation of chemical bonds with the partner in friction, leading to an increase in the coefficient of friction and possibly bonding, especially if the other partner is of the same nature [A. Erdemir, C. Donnet "Tribology of Diamond, Diamond-Like Carbon, and Related Films"]. Passivation of these dangling bonds may result from the ambient environment, humidity, gas.

In the case of friction in the escapement of CVD diamond on surfaces of several tens of microns width with a very low contact force (~1 mN), it seems that passivation by the ambient environment hardly occurs, leading to pronounced wear, to the formation of graphite debris, sp2, which speeds up blockage of the escapement through bonding.

The friction mechanisms between diamond and other materials are very complex.

However, a partner in friction with diamond, capable of directly providing free atoms to form links with the dangling carbon bonds, would favour passivation at the low contact forces encountered in the movement. Passivation prevents the appearance of bonding.

Stable low coefficients were obtained in friction with micro-crystalline CVD diamond against a boron ceramic called BAM ($AlMgB14+TiB2$, "NewTech Ceramics").

Good tribological behaviour without bonding is also obtained with other types of boron ceramic in friction against single crystal, micro-crystalline or nano-crystalline diamond.

Typically, boron ceramics such as BAM can be fabricated in thin layers or in solid form. Manufacturing methods for obtaining thin layers of ceramics are notably, but non-exhaustively: PVD (sputtering, pulsed laser deposition, etc.), CVD, LPCVD, PECVD. The manufacture of solid ceramics is generally achieved through a powder sintering method.

Within the scope of a timepiece application, a particularly promising configuration concerns an escapement, and particularly a Swiss lever or coaxial escapement, having an escape wheel (and/or pinion) made in CVD diamond coated silicon, in friction against solid boron ceramic pallet-stones.

Non-exhaustive configurations obtainable with the invention can be cited:

silicon wheel coated with boron ceramic/silicon pallet-stones coated with CVD diamond;

silicon wheel coated with CVD diamond/silicon pallet-stones coated with boron ceramic;

silicon wheel coated with CVD diamond/solid boron ceramic pallet-stones.

It is to be noted that the silicon substrate can be replaced by other materials such as metals, silicon carbide, silicon nitride, silicon oxide, quartz, glass or any other ceramics or materials permitting the deposition and adhesion of the boron ceramic layer or of the CVD diamond layer.

The thickness of the boron ceramic or diamond layer typically ranges from 100 nanometers to 10 micrometers.

Boron ceramic is advantageously selected in order to obtain a high hardness close to that of CVD diamond. Sub-layers may be used so as to: promote adhesion of the layer to the boron and/or to affect its state of stress.

Obviously, not all boron ceramics fulfil the same function.

The following boron ceramics, in particular, can be used:

- aluminium-magnesium boride ($AlMgB14$) or BAM+titanium diboride ($TiB2$)
- aluminium-magnesium boride ($AlMgB14$) or BAM borides: ($TiB_2$,$AlB_2$,$ZrB_2$,$TaB_2$,NiB,$VB_2$,$SiB_4$, boron carbide $B_4C$, and similar)

cubic boron nitride (CBN), especially polycrystalline CBN boric trioxide or anhydrous boric oxide ($B_2O_3$).

It is also known that ceramics containing boron, such as $B_4C$, $TiB_2$, or BAM, particularly produced by "New Tech Ceramics", or similar, exhibit excellent friction properties with silicon dioxide ($SiO_2$).

Indeed, this boron ceramic/silicon dioxide pair exhibits the advantage, compared to the boron ceramic/diamond pair, of not being dependant on ambient humidity. The $H_2$ and $H_2O$ contained in silicon oxide, especially that obtained by wet oxidation, enable a boric acid film to form at the interface ensuring self-lubrication, even in the event of low ambient humidity. While the boron/diamond pair provides good tribological performance at ambient humidity greater than 40%, the boron ceramic/$SiO_2$ pair allows very low friction coefficients (<0.2) to be obtained at ambient humidity lower than 40%.

The invention also concerns carbon allotropes, such as: micro-nano-crystalline CVD diamond, solid monocrystalline diamond and DLC (diamond like carbon). Typically, these carbon allotropes are deposited in thin layers using the usual techniques, such as: CVD, PECVD, PVD, etc.

Solid synthetic or natural diamond can replace ruby pallet-stones; diamond pallet-stones are thus in friction against a wheel coated with a boron ceramic.

Thus, in a preferred application, the invention concerns a timepiece mechanism 100 comprising at least one pair 1 of components including a first component 2 including a material taken from a first group including silicon dioxide, natural diamond, micro- or nano-crystalline CVD diamond, solid monocrystalline diamond, and amorphous carbon known as diamond-like carbon or "DLC", and having a first friction surface 21 arranged to cooperate with a second friction surface 31 comprised in a second opposing component 3.

According to the invention, the second component 3 includes, at least in its second friction surface 31, a material with a high concentration of boron.

Preferably this material has a boron concentration of more than 10 atomic percent.

This material with a high boron concentration may be a ceramic, a metal alloy, a composite material or similar.

More specifically, the second opposing component 3 includes at least one ceramic containing boron.

"Ceramics" means here non-metallic, inorganic materials.

This second component 3 includes at least one ceramic containing boron, either in a surface layer 30 or in the mass of this second component 3.

In a particular variant, at least one surface layer 30 of second component 3 is formed exclusively by one or more ceramics containing boron.

More specifically still, second component 3 is formed exclusively by one or more ceramics containing boron.

In a particular variant, the ceramic containing boron, comprised in second component 3, is made of a material taken from a second group including orthorhombic boride of formula: AlMgB14, orthorhombic boride of formula: Al0.75Mg0.75B10, titanium diboride ($TiB_2$), aluminium diboride ($AlB_2$), zirconium diboride ($ZrB_2$), tantalum diboride ($TaB_2$), nickel boride (NiB), vanadium triboride ($VB_3$), silicon quadriboride ($SiB_4$), boron ($B_4C$), polycrystalline cubic boron nitride (CBN), hexagonal boron nitride, anhydrous boric oxide ($B_2O_3$).

In a particular variant, the ceramic containing boron is a non-oxide ceramic.

In a particular variant, the ceramic containing boron includes an orthorhombic boride of formula: AlMgB14.

In a particular variant, the ceramic containing boron includes an orthorhombic boride of formula: Al10.75Mg0.75B14.

In a particular variant, the ceramic containing boron includes titanium diboride ($TiB_2$).

In a particular variant, the ceramic containing boron includes, on the one hand an orthorhombic boride of formula: AlMgB14 or Al0.75Mg0.75B14, and on the other hand, titanium diboride ($TiB_2$).

In a particular variant, the ceramic containing boron is aluminium-magnesium boride known as BAM and including, on the one hand an orthorhombic boride of formula: AlMgB14, and on the other hand, titanium diboride ($TiB_2$).

In a particular variant, first component 2 includes a first friction layer 20 made of micro- or nano-crystalline CVD diamond.

In a particular variant, the first component 2 includes a first friction layer 20, the second component 3 includes a surface friction layer 30 and the first friction layer 20 and second friction layer 30 each have a thickness of between 100 nanometers and 10000 nanometers.

In a particular variant, the first component 2 includes a first friction layer 20, second component 3 includes a surface friction layer 30, and first friction layer 20 and second friction layer 30 have similar surface hardnesses as regards first friction surface 21 and second friction surface 31 respectively comprised therein.

In a particular variant, the first component 2 includes a first friction layer 20 and this first friction layer 20 is made in a substrate in a material taken from a third group including silicon, silicon oxide, silicon dioxide, silicon carbide, silicon nitride, quartz, glass.

In a particular variant, second component 3 includes a surface friction layer 30, and this second friction layer 30 is made in a substrate in a material taken from a third group including silicon, silicon oxide, silicon dioxide, silicon carbide, silicon nitride, quartz, glass.

In a particular variant, the second component 3 includes a surface friction layer 30, and this second friction layer 30 is made in a substrate in a material taken from a fourth group including carbon steels, cobalt-based super-alloys, "Phynox" K13C20N16Fe15D7, «Durnico» Z2NKDT 18-05-05, Cu Be1.9, brasses, maraging steels, HIS steels. In a particular variant, the first component 2 includes a first friction layer 20 and this first component 2 is in one-piece with first friction layer 20 in a material taken from the first group cited above.

In a particular variant, the second component 3 includes a surface friction layer 30, and this second component 3 is in one-piece with this second friction layer 30 in a material formed by a ceramic containing boron, or including at least one ceramic containing boron.

In a particularly advantageous application, mechanism 100 is an escapement mechanism, and includes a plurality of such pairs 1, each formed on the basis, on the one hand, of a tooth 4 of an escape wheel 40, and on the other hand, of a pallet-stone 5 of a pallet lever 50.

In a variant, each tooth 4 is made of boron ceramic coated silicon, and each said pallet-stone 5 is made of CVD diamond coated silicon.

In a variant, each tooth 4 is made of CVD diamond coated silicon, and each pallet-stone 5 is made of boron ceramic coated silicon.

In a variant, each tooth 4 is made of CVD diamond coated silicon, and each pallet-stone 5 is made of solid boron ceramic.

Preferably and advantageously, the contact between the first friction surface 21 and the second friction surface 31 is a dry contact free of any lubricant.

The invention also concerns a timepiece movement 200 including at least one timepiece mechanism 100 of this type.

The invention also concerns a timepiece 300 including at least one timepiece movement 200 of this type, and/or at least one timepiece mechanism 100 of this type.

The invention is naturally applicable to timepiece mechanisms other than the escapement mechanism described here and which represents a particularly advantageous example application of the invention The invention also concerns a method for making such a timepiece mechanism 100. According to the invention:

- a first component 2 is made and either coated with a first friction layer 20 in a material taken from said first group, or is made solid in a material taken from said first group;
- a second component 3 is made, and either coated with a second layer 30 formed by a ceramic containing boron, or including at least one ceramic containing boron, or is made solid in a material including at least one ceramic containing boron;
- a first friction surface 21 of first component 2 and notably of first friction layer 20 if this first moving component 2 is coated, is made to cooperate in dry contact, without lubricant, with a second friction surface 31 of second component 3, and notably of second friction layer 30 if this second moving component 3 is coated.

The invention also concerns a method for transforming a timepiece mechanism of the type comprising at least one pair 1 of components including a first component 2 including a first friction surface 21 arranged to cooperate with a second friction surface 31 comprised in a second opposing component 3. According to the invention:

a first friction layer 20 in a material taken from a first group including including silicon dioxide, natural diamond, micro- or nano-crystalline CVD diamond, solid monocrystalline diamond, and amorphous carbon known as diamond-like carbon or "DLC" is applied to the first friction surface 21 to form a new first hard friction surface 201, and a second friction layer 30, formed by a ceramic containing boron or including at least one ceramic containing boron, is applied to the second friction surface 31 to form a new second hard friction surface 310, and the new first hard friction surface 210 is made to cooperate in dry contact, without lubricant, with the new second hard friction surface 310.

What is claimed is:

1. A timepiece mechanism comprising at least one pair of components including a first component including a material selected from a first group consisting of silicon dioxide, natural diamond, micro- or nano-crystalline CVD diamond, solid monocrystalline diamond, and amorphous carbon known as diamond-like carbon or "DLC", and having a first friction surface arranged to cooperate with a second friction surface comprised in a second opposing component, wherein said second opposing component includes, at least in said second friction surface thereof, a material with a high concentration of boron, greater than 10 atomic percent, and wherein said second component includes at least one ceramic containing boron.

2. The timepiece mechanism according to claim 1, said second component includes at least said ceramic containing boron, either in a surface layer, or in the mass of said second component.

3. The timepiece mechanism according to claim 1, wherein at least one surface layer of said second component is formed exclusively by one or more ceramics containing boron.

4. The timepiece mechanism according to claim 1, wherein said second component is formed exclusively by one or more ceramics containing boron.

5. The timepiece mechanism according to claim 1, wherein said ceramic containing boron is in a material taken from a second group including orthorhombic boride of formula: AlMgB14, orthorhombic boride of formula: A10.75Mg0.75B14, titanium diboride, aluminium diboride, zirconium diboride, tantalum diboride, nickel boride, vanadium triboride, silicon quadriboride, boron carbide, polycrystalline cubic boron nitride, hexagonal boron nitride, anhydrous boric oxide.

6. The timepiece mechanism according to claim 1, wherein said ceramic containing boron is a non-oxide ceramic.

7. The timepiece mechanism according to claim 1, wherein said ceramic containing boron includes an orthorhombic boride of formula: AlMgB14.

8. The timepiece mechanism according to claim 1, wherein said ceramic containing boron includes an orthorhombic boride of formula: Al0.75Mg0.75B14.

9. The timepiece mechanism according to claim 1, wherein said ceramic containing boron includes titanium diboride.

10. The timepiece mechanism according to claim 1, wherein said ceramic containing boron includes an orthorhombic boride of formula: AlMgB14 or Al0.75Mg0.75B14, and titanium diboride.

11. The timepiece mechanism according to claim 10, wherein said ceramic containing boron is aluminium-magnesium boride known as BAM and includes an orthorhombic boride of formula: AlMgB14, and titanium diboride.

12. The timepiece mechanism according to claim 10, wherein said first component includes a first friction layer made of micro- or nano-crystalline CVD diamond.

13. The timepiece mechanism according to claim 1, wherein said first component includes a first friction layer and wherein said second component includes a second friction layer, and wherein said first friction layer and said second friction layer each have a thickness of between 100 nanometers and 10000 nanometers.

14. The timepiece mechanism according to claim 1, wherein said first component includes a first friction layer and wherein said second component includes a second friction layer, and wherein said first friction layer and said second friction layer have similar surface hardnesses on said first friction surface and second friction surface.

15. The timepiece mechanism according to claim 1, wherein said first component includes a first friction layer, and wherein said first friction layer is made in a substrate in a material taken from a third group including silicon, silicon oxide, silicon dioxide, silicon carbide, silicon nitride, quartz, glass.

16. The timepiece mechanism according to claim 1, wherein said second component includes a second surface friction layer, and wherein said second friction layer is made in a substrate in a material taken from a third group including silicon, silicon oxide, silicon dioxide, silicon carbide, silicon nitride, quartz, glass.

17. The timepiece mechanism according to claim 1, wherein said second component includes a second surface friction layer, and wherein said second friction layer is made in a substrate in a material taken from a fourth group including carbon steels, cobalt-based super-alloys, copper alloys, brasses, maraging steels, high intensity stainless steels.

18. The timepiece mechanism according to claim 1, wherein said first component includes a first friction layer, and wherein said first component is in one-piece with said first friction layer in a material taken from said first group.

19. The timepiece mechanism according to claim 1, wherein said second component includes a surface friction layer, and wherein said second component is in one-piece with said second friction layer in a material formed by a ceramic containing boron, or including at least one ceramic containing boron.

20. The timepiece mechanism according to claim 1, wherein the contact between said first friction surface and said second friction surface is a dry contact.

21. A timepiece movement including at least one timepiece mechanism according to claim 1.

22. A timepiece including at least one timepiece mechanism according to claim 1.

23. A method for making a timepiece mechanism according to claim 1, wherein:

one said first component includes a first friction layer made and coated in a material taken from said first group;

one said second component includes a second friction layer made and coated in a ceramic containing boron, or including at least one ceramic containing boron;

one said first friction surface of said first friction layer is made to cooperate in dry contact, without lubricant, with one said second friction surface of said second friction layer.

24. A timepiece mechanism comprising at least one pair of components including a first component including a material taken from a first group including silicon dioxide, natural diamond, micro- or nano-crystalline CVD diamond, solid monocrystalline diamond, and amorphous carbon known as diamond-like carbon or "DLC", and having a first friction surface arranged to cooperate with a second friction surface comprised in a second opposing component, wherein said second opposing component includes, at least in said second friction surface thereof, a material with a high concentration of boron, greater than 10 atomic percent, and wherein said first component includes a first friction layer, and wherein said first component is in one-piece with said first friction layer in a material taken from said first group.

25. A timepiece mechanism comprising at least one pair of components including a first component including a material taken from a first group including silicon dioxide, natural diamond, micro- or nano-crystalline CVD diamond, solid monocrystalline diamond, and amorphous carbon known as diamond-like carbon or "DLC", and having a first friction surface arranged to cooperate with a second friction surface comprised in a second opposing component, wherein said second opposing component includes, at least in said second friction surface thereof, a material with a high concentration of boron, greater than 10 atomic percent, and wherein said second component includes a surface friction layer, and wherein said second component is in one-piece with said second friction layer in a material formed by a ceramic containing boron, or including at least one ceramic containing boron.

26. A timepiece mechanism comprising at least one pair of components including a first component including a material taken from a first group including silicon dioxide $SiO_2$, natural diamond, micro- or nano-crystalline CVD diamond, solid monocrystalline diamond, and amorphous carbon known as diamond-like carbon or "DLC", and having a first friction surface arranged to cooperate with a second friction surface comprised in a second opposing component, wherein said second opposing component includes, at least in said second friction surface thereof, a material with a high concentration of boron, greater than 10 atomic percent, and wherein the mechanism is an escapement mechanism and includes a plurality of said pairs, each formed on the basis, on the one hand, of a tooth of an escapement wheel set, and on the other hand, of a pallet-stone of a pallet lever.

27. The timepiece mechanism according to claim 26, wherein said each said tooth is made of boron ceramic coated silicon, and wherein each said pallet-stone is made of CVD diamond coated silicon.

28. The timepiece mechanism according to claim 26, wherein said each said tooth is made of CVD diamond coated silicon, and wherein each said pallet-stone is made of boron ceramic coated silicon.

29. The timepiece mechanism according to claim 26, wherein said each said tooth is made of CVD diamond coated silicon, and wherein each said pallet-stone is made of solid boron ceramic.

30. The timepiece mechanism according to claim 26, wherein said each said tooth is made of solid boron ceramic, and wherein each said pallet-stone is made of CVD diamond coated silicon.

31. A method for transforming forming a timepiece mechanism comprising at least one pair of components including a first component including a first friction surface arranged to cooperate with a second friction surface comprised in a second opposing component, wherein:

a first friction layer in a material taken from a first group including silicon dioxide, natural diamond, micro- or nano-crystalline CVD diamond, solid monocrystalline diamond, and amorphous carbon known as diamond-like carbon or "DLC" is applied to said first friction surface to form a new first hard friction surface, and a second friction layer, formed by a ceramic containing boron or including at least one ceramic containing boron, is applied to said second friction surface to form a new second hard friction surface, and said new first hard friction surface is made to cooperate in dry contact, without lubricant, with said new second hard friction surface.

* * * * *